United States Patent [19]

Dalebout

[11] 4,078,322

[45] Mar. 14, 1978

[54] SKI BOOT

[75] Inventor: Melvin W. Dalebout, Salt Lake City, Utah

[73] Assignee: Engineered Sports Products, Inc., Salt Lake City, Utah

[21] Appl. No.: 711,476

[22] Filed: Aug. 4, 1976

[51] Int. Cl.[2] ..... A43B 5/04; A43B 3/10; A43B 21/36

[52] U.S. Cl. ..... 36/121; 36/10; 36/80

[58] Field of Search ..... 36/117, 119, 120, 132, 36/99, 80, 10, 121

[56] References Cited

U.S. PATENT DOCUMENTS

| | | | |
|---|---|---|---|
| 3,313,046 | 4/1967 | Werner et al. | 36/119 |
| 3,545,103 | 12/1970 | Bloomfield et al. | 36/120 |
| 3,786,580 | 1/1974 | Dalebout | 36/117 |
| 3,984,124 | 10/1976 | Gertsch | 36/117 |

*Primary Examiner*—Patrick D. Lawson
*Attorney, Agent, or Firm*—Trask & Britt

[57] ABSTRACT

A ski boot is constructed with a relatively rigid bottom foot enclosure, a somewhat more flexible cuff portion pivotally connected to the foot enclosure at the axis of the ankle, and an even more flexible spat portion arranged to close over the upper portion of the foot. A bottom traction surface comprised of heel and sole portions is removably connectable to the boot. The bottom of the foot enclosure and the traction element are mutually adapted to provide a variable cant for the foot enclosure with respect to the bottom of the traction element. A removable inner boot of soft cellular foam material is provided within the foot enclosure, and is slit down the front to facilitate foot entry without a tongue. The inner boot is also provided with external spacing tabs in the vicinity of the lower ankle to ensure a snug fit around the heel. The cuff portion is releasably engageable by a spring biased connector located at the back of the boot. Forward pivoting of the cuff with respect to the foot enclosure is guided by a pin extending from a wall of the foot enclosure through a slot in the cuff. This slot may be partially filled by a suitable insert to restrain backward movement of the cuff.

26 Claims, 9 Drawing Figures

SKI BOOT

BACKGROUND OF THE INVENTION

1. Field

This invention pertains to ski boots and provides such a boot with several novel features. Specifically, this invention provides a ski boot with a removable, cantible traction element; a novel system for controlling forward pivot of the cuff portion of the boot with respect to the bottom foot enclosure of the boot; and a novel removable inner boot of improved design. This invention also provides, among other things, a ski boot comprised of several components each of which has selected properties of toughness, flexibility and rigidity.

2. State of the Art

Over the past several years ski boots have evolved through several stages from stiff unlined boots of leather to the present rigid outer boots (generally of plastic) with flexible liners of various types. For use with modern bindings, it is essential that the outer boot be stiff to optimise the control effected on the skis by a skier shifting his weight or the attitude of his feet. On the other hand, the inner boot desirably provides for adequate comfort so that the skier can tolerate wearing the boots for extended periods.

Several approaches to boot construction have been tried to achieve the desired combination of outer boot rigidity, ease of forward ankle movement and adequate comfort for the skier. Thus far, no approach has been entirely successful, although substantial progress has been made. Attendant to this progress, however, has been the introduction of certain structural problems and limitations. For example, it has been found expedient in many instances to construct the outer boot shell from more pliable material than is desired for good control of the skis. Pliable materials permit flexture of the outer boot to accommodate forward ankle movement as the skier leans forward.

It has long been recognized that individual skiers require different adjustments or adaptation devices to ensure a proper cant between the soles of their feet and the skis. Otherwise, as the skier bends forward or brings his knees forward with respect to the tips of the skis, his knees do not retain proper alignment. Conventionally, this problem has been corrected by inserting wedges beneath the bindings of the skis. These wedges or shims effect a proper cant selected to adjust the weight moment of the individual skier to the desired position with respect to the skis. A skier utilizing several pair of skis, which is often done in areas where snow conditions are variable throughout a season or even a day, requires customized canting of the bindings on each pair of skis. Skis so adapted may not readily be worn by any other skier who does not require the same canting.

Modern plastic ski boots are typically discarded when their traction surfaces become worn. Although the remainder of the boot may be in good condition, worn heels and soles make it difficult to retain the boots in their bindings.

Inner boots have been sold with ski boots for many years. Some of these inner boots are constructed of microcellular foam material. Although various techniques have been used to custom fit inner boots to individual feet, the industry would prefer to avoid such techniques. Inner boots have thus tended to fit badly in the heel region.

SUMMARY OF THE INVENTION

The present invention provides a ski boot which is substantially improved over those of the prior art. Thus, the boot of this invention includes an outer shell of unique construction which receives an improved microcellular inner boot. Moreover, removable sole and heel portions are adapted to incorporate selected cants, thereby avoiding the disadantages attendant conventional canting methods. These removable portions each have bottom traction surfaces and extensions. The extensions have upper surfaces adapted for gripping by toe and heel bindings respectively. The extensions include sockets configurated to receive structural extensions from the outer shell. When the sole and/or heel become worn, they may be replaced, thereby extending the useful life of the ski boots.

The outer shell itself includes a rigid foot enclosure, a more flexible cuff and still more flexible spat component. The heel and sole elements are also more flexible than the foot enclosure.

BRIEF DESCRIPTION OF THE DRAWINGS

In the drawings, which illustrate what is presently regarded as the best mode for carrying out the invention.

DESCRIPTION OF THE ILLUSTRATED EMBODIMENT

Figure 2:
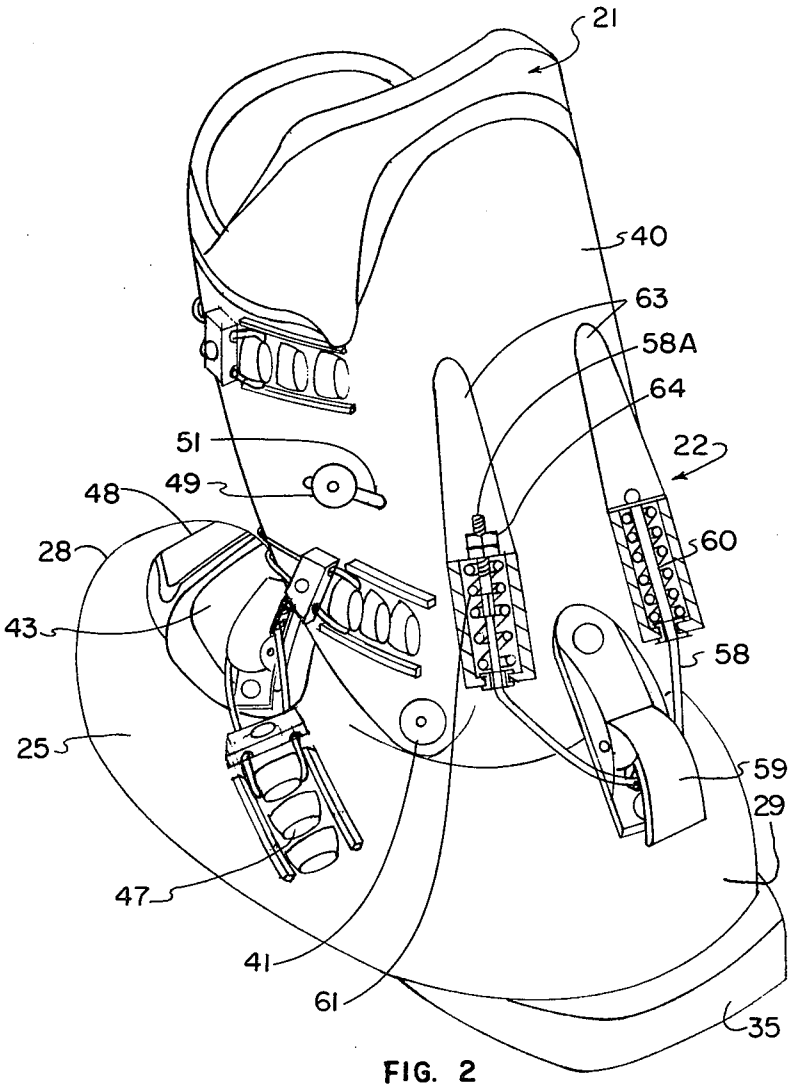
FIG. 2 is a view in partial perspective of the boot of FIG. 1 as viewed from the opposite side and from the rear.
Figure 1:
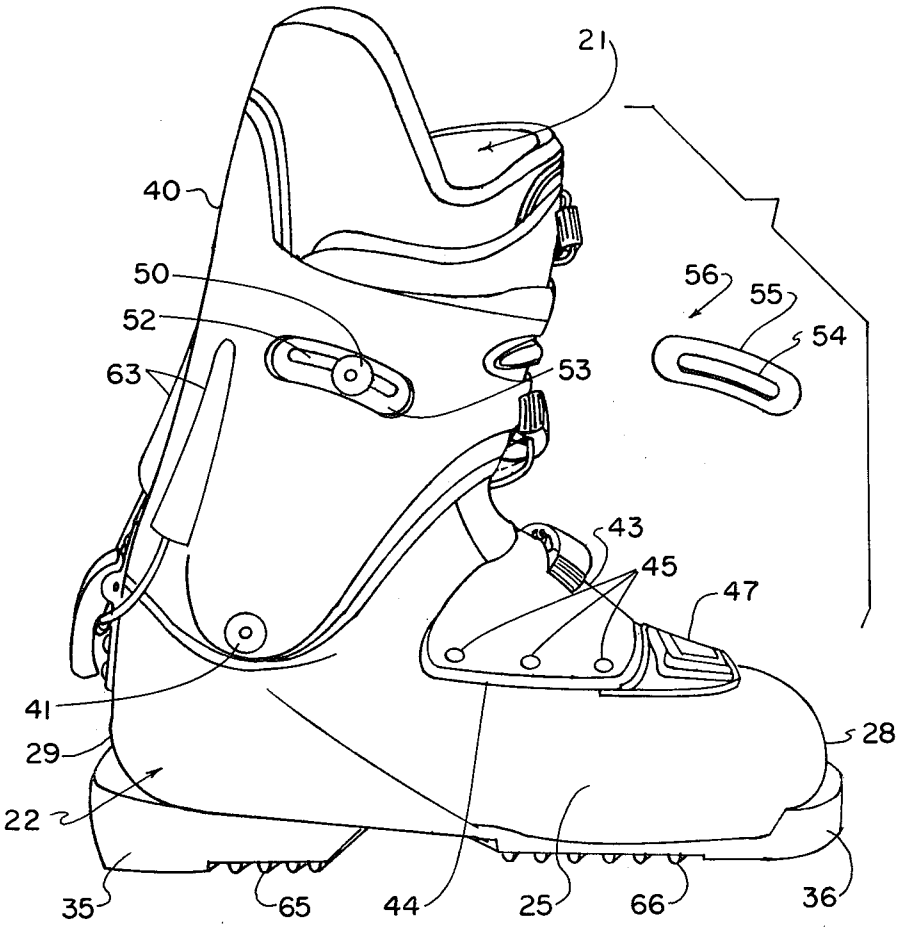
FIG. 1 is a side view of a ski boot of the invention in fully assembled condition together with an auxiliary part.
Figure 5:
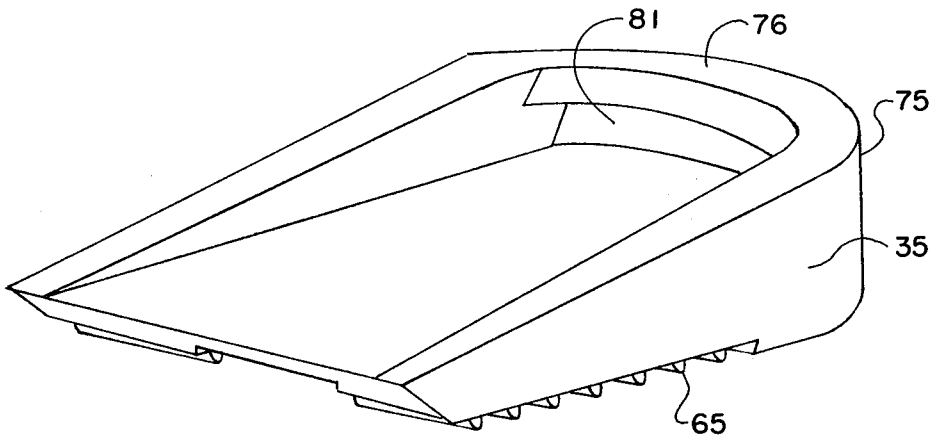
FIG. 5 is a perspective view of a removable heel.
Figure 6:
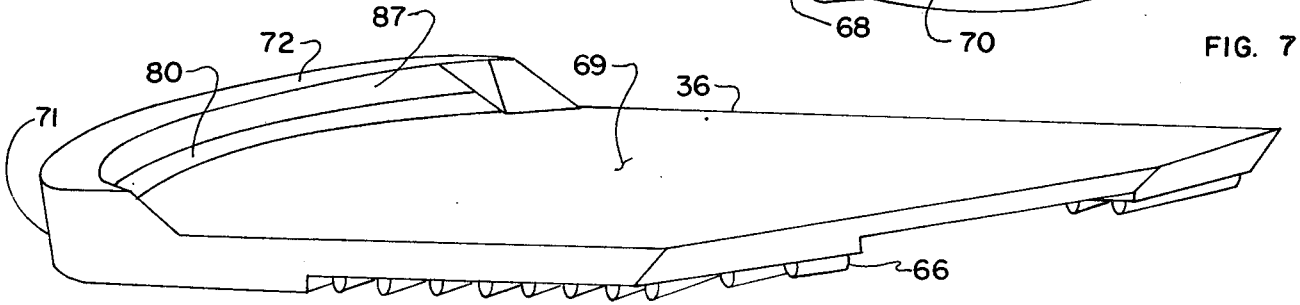
FIG. 6 is a perspective view of a removable sole.

FIGS. 1 and 2 show a fully assembled ski boot of this invention, including a pliable inner boot 21 within a rigid outer shell 22. The structure and operation of the outer shell has much in common with the ski boot described in U.S. Pat. No. 3,521,385, the disclosure of which is incorporated herein by reference. For example, the shell 22 is comprised of a rigid foot enclosure 25 (See FIG. 7) including a pair of ankle plates 26 upstanding from and forming a portion of a bifurcated top wall 27. This top wall 27 extends between and is integral with a toe enclosure 28 and a heel enclosure 29. As an important improvement offered by this invention, the bottom 30 of the foot enclosure is adapted to receive removable traction plates 35 (FIG. 5) and 36 (FIG. 6). A separate cuff element 40 is connected to the ankle plates 26 by suitable means, such as the rivet 41 shown, approximately at the axis of the ankle of a foot positioned in the boot. Similarly, a spat 43 is fastened at one edge 44 by rivets 45 to overlay the bifurcated top wall 27 of the foot enclosure 22. The opposite edge of the spat 43 may be drawn down against the foot enclosure 25 by means of a buckle arrangement 47. By so doing, the segments of the bifurcated wall 27 are drawn together to clamp the foot snugly. A decorative toe cap 48 is illustrated as a cosmetic feature fixed to the foot enclosure 22 just forward of the spat 43.

As best shown by FIG. 2, the cuff 40 is mounted to the foot enclosure 22 to pivot forward and backward with respect to the toe enclosure 28. Its travel is guided by a pair of rivets 49, 50 extending from attachment to the ankle plates 26 through slots 51, 52 in the portions of the cuff 40 comprising, respectively, the outer and inner surfaces of the boot. The outer head of rivet 50 travels in an arcuate recess 53. This arrangement avoids engagement by the rivet 50 of the corresponding member carried by its mated boot or the edge of the adjacent ski. The slot 52 and recess 53 correspond to elements 54, 55 of a plug 56. Certain skiers who desire to limit rearward pivoting of the cuff 40 (that is, to fix a permanent forward attitude of the cuff even when the skier's legs are straightened), may cut a desired section from the plug 56 and insert the element 54 through the slot 52 to, in effect, shorten the slot 52. Desirably, the plug 56 is inserted from inside the cuff so that it is held in place by the ankle plates 26.

A flexible element, such as the plastic-coated cable 58 shown is looped through a buckle arrangement 59 anchored to the heel enclosure 29. Although a portion of the buckle arrangement 59 may overlap the cuff 40, these two structures are connected only releasably through the cable 58. The opposite ends of the cable 58 are suspended from compression springs 60, 61 contained within hollow bosses 63 carried by the cuff 40. These bosses 63 open to the inside of the cuff 40 to permit insertion of the springs 60, 61 and threading of the cable 58 as shown. One end 58A of the cable is adapted to receive threaded nuts 64 to hold the assembly in place. With the buckle 59 and cable 58 engaged as shown, forward pivoting of the cuff 40 works against the springs 60, 61. Proper tension can be provided by selecting springs 60, 61 of appropriate properties. Additional adjustment can be effected by tightening or loosening the nuts 64. The buckle 59 may be operated to release the cable 58, thereby permitting the cuff 40 to pivot with much less resistance. This unbuckled mode is of particular use when a skier desires to remove his skis and walk in the ski boots. Ski boots without this capability are typically unyielding in the vicinity of the ankle, making normal walking difficult.

Figure 7:
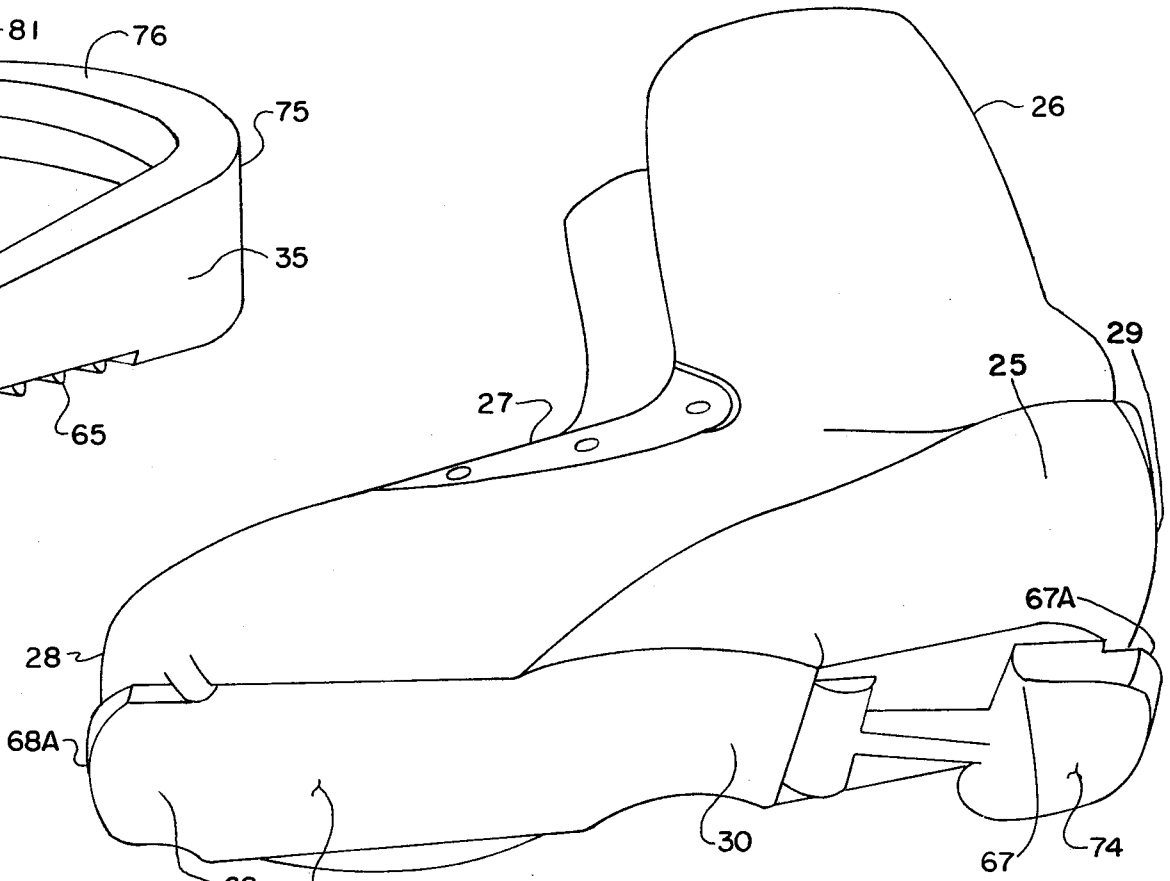
FIG. 7 is a perspective view of a portion of a ski boot adapted to receive the heel and sole illustrated by FIGS. 5 and 6.

Among the novel improvements of this invention is the adjustable canting of the traction surfaces 65, 66 of the elements 35, 36 with respect to the bottom 30 of the foot enclosure 25. Although a single member could replace the elements 35, 36, it is preferred to provide separate heel 35 and toe 36 pieces as shown. Referring to FIG. 7, the bottom 30 of the foot enclosure 25 includes a structural member 67 with a tab or extension element 67A projecting beyond the heel enclosure 29. Similarly, a structural member 68 at the front of the bottom 30 carries a tab or extension element 68A projecting beyond the toe enclosure 28. The traction element 36 (FIG. 6) includes, in addition to the traction surface 66, an upper mating surface 69 adapted to mount flush against the corresponding portion 70 of the bottom, and a nose portion 71 adapted to interlock with the tab 68A. The nose 71 includes an upper surface which is substantially parallel the traction surface 66, and is spaced therefrom to constitute means for attachment (e.g., by clamping) to conventional toe binding apparatus of the type commonly mounted on "alpine" or "downhill" skis. The traction element 35 is similarly adapted with an upper surface for mounting against the corresponding portion 74 of the bottom 30. It includes a tail portion 75 adapted to interlock with the extension 67A. This portion 75 carries an upper surface 76 substantially parallel the traction surface 65 and spaced therefrom to constitute means for attachment to conventional heel binding apparatus. Various expedients for interlocking the nose 71 and tail 75 portions to the extensions 68A, 67A may be devised, but as illustrated, a recess 80 in the nose 71 beneath the surface 72 fits snugly over the extension 68A so that forces on the surface 72 are translated to the foot enclosure 25 through the extension 68A. Similarly, the recess 81 fits snugly over the extension 67A so that forces on the surface 76 are translated to the foot enclosure 25 through the extension 67A.

With the traction elements 35, 36 fastened to the ski boot shell 22, and both of these elements anchored to a ski with conventional bindings, the traction surfaces 65, 66 are either flush against the top surface of the ski or separated by only a thin plate constituting a portion of the binding apparatus. In any event, if the skier has exactly the right anatomical characteristics, when he stands erect, his weight should be transferred straight down from the soles of his feet to the skis. In fact, very few skiers possess these characteristics. Thus, shims or cants are often placed beneath ski bindings to rotate the traction surface of conventional ski boots, and incidentially the soles of the skiers feet, slightly (typically about 1° to about 5°) around an axis parallel the longitudinal axis of the skis. In this fashion, the vertical moment of the skier's weight over each foot may be adjusted to directly above (or at least very near) the desired region of the ski. The present invention accomplishes the same purpose, but avoids the use of shimed bindings, while maintaining the traction surfaces of the boots in contact with or parallel the upper surfaces of the skis.

Figure 9:
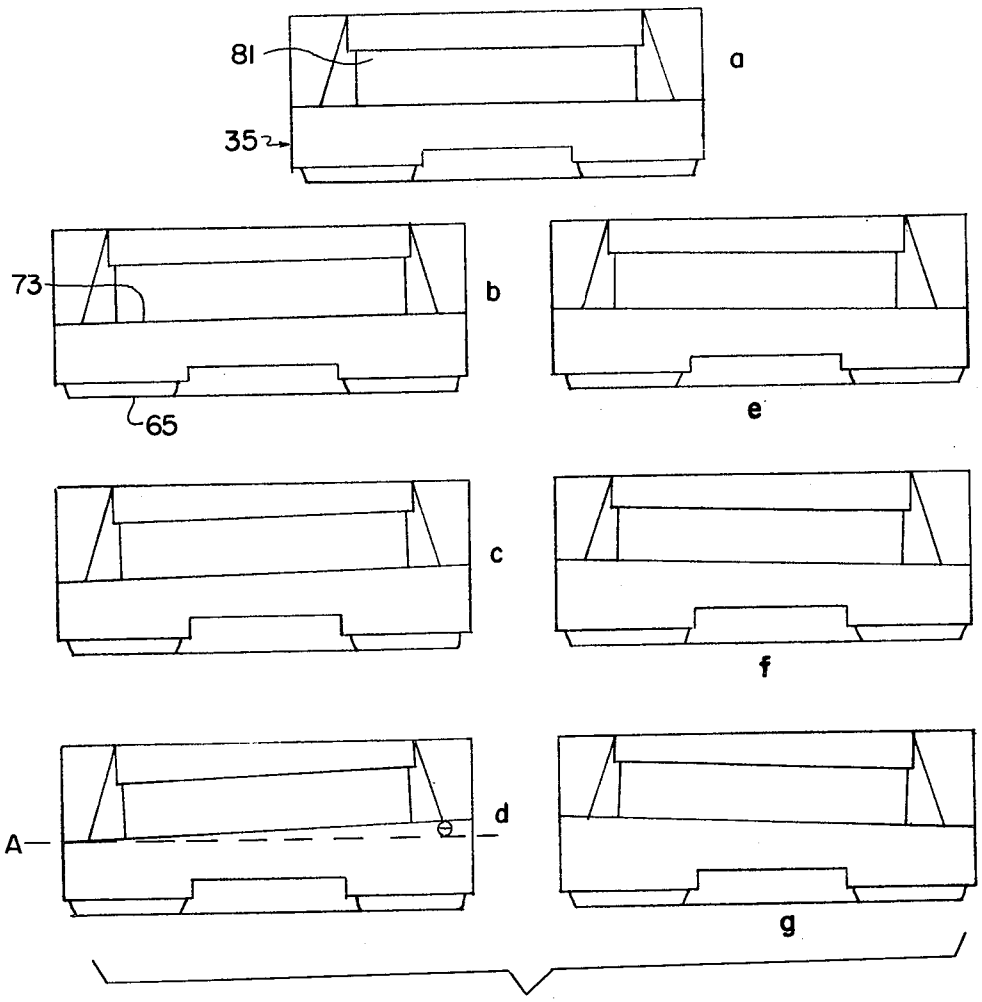
FIG. 9 is a series of views in front elevation corresponding to the series of FIG. 8 but showing removable heels of FIG. 5.
Figure 8:
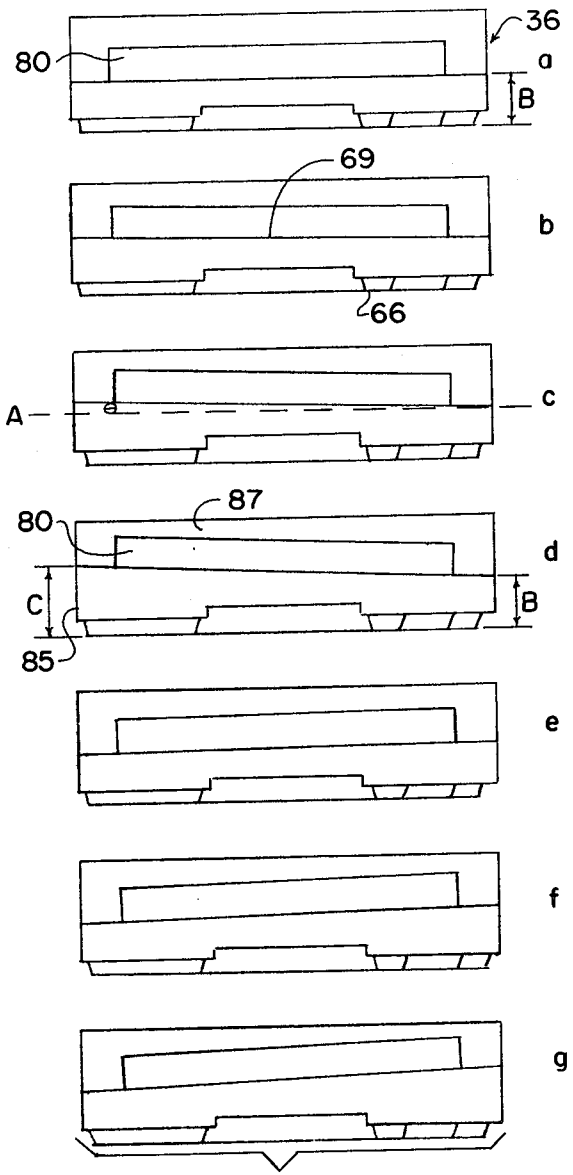
FIG. 8 is a series of views in front elevation showing several of the removable soles of FIG. 6.

FIGS. 8 and 9 illustrate one highly preferred form of the invention as it pertains to selectable precanted construction. Each of these figures shows a series of either toe pieces 36 (FIG. 8) or heel pieces 35 (FIG. 9) with the mating surfaces 69, 73, respectively, prebuilt (e.g., by injection molding) or machined to a specified cant angle. The several views of FIGS. 8 and 9 are correlated. Thus, FIGS. 8*a* and 9*a* illustrate the elements 35, 36 at 0° cant; i.e., the surfaces 69, 73 are parallel the respective traction surfaces 66, 65. FIGS. 8*b* and 9*b* illustrate a slight cant in one direction (toward the inside of the left boot) while FIGS. 8*e* and 9*e* illustrate a slight cant in the opposite direction. The cant angle may be defined as the included angle between the surface plane 69 or 73 and a reference line A included in a plane parallel the traction surface 66, 65 as shown. As is apparent from the drawings, the remaining views of FIGS. 8 and 9 illustrate corresponding elements canted to greater degrees. The series of canted surfaces may be standarized according to an arbitrary scale which more or less conforms to that currently applied by the art to binding shims. A useful such scale is set forth in the following table.

| View from FIGS. 8 and 9 | Cant No. | Direction | Cant Angle |
|---|---|---|---|
| a | 0 | — | 0° |
| b | 1 | in | 1 ½° |
| c | 2 | in | 3° |
| d | 3 | in | 4 ½° |
| e | 1 | out | 1 ½° |
| f | 2 | out | 3° |
| g | 3 | out | 4 ½° |

Of course, it is possible to provide other cants within the series, either within the 4½° in, 4½° out range shown or to extend the range, although cants greater than about 6° are rarely required. In general, the precise cant required for a particular skier is determined either electronically or mechanically, e.g., by means of conventional equipment generally available to pro ski shops for selecting binding shims. Different cants may be required for each of a pair of ski boots. The proper set of precanted heel and toe pieces may be selected from a stock of parts based on these measurements, or the proper cant may be applied to the surfaces 69, 73 by either stock removal or stock addition methods.

Referring again to FIGS. 8 and 9, cants are preferably structured as a ramped surface atop the normal uncanted mounting surfaces 69, 73 of FIGS. 8*a* and 9*a*. For example, comparing FIGS. 8*a* and 8*d*, the dimension B is the thickness of the traction element 36 measured between the traction surface 66 and the uncanted mounting surface 69. To effect a cant, one edge 85 is built up to an increased thickness C. A corresponding amount of material is removed from the surface 86 so that the proper dimensions of the slot 80 are maintained. Reduction of the thickness of the overlap 87 above the slot 80 is not detrimental because the force of the ski binding is translated to the toe extension 68A putting the overlap 87 into compression. The function of the overlap 87 is basically to hold the dimensions of the nose 72 to a standard without regard to the cant built into the traction element 36. Exactly the same considerations hold true with respect to the traction element 35.

Optimum comfort and durability is built into the outer shell through correlation of the properties of the materials of construction selected for the various components of the boot. As general guidelines, the traction elements 35,36 should be of suitable composition to cushion and absorb the shocks of walking while offering good wear characteristics. The spat 43 is selected from the softest (or most pliable) material that can be tolerated consistent with the requirements of foot wear to permit deformation and flexure as the cuff 40 pivots forward into contact with the spat. (The toe cap 47 may conveniently be of the same material as the spat 43.) The cuff 40 should also be flexible, but cannot tolerate as much stretch as may the spat 43. The cuff 40 is wrapped around the front of the boot and must maintain a firm pressure against the front of the inner boot 21. The foot enclosure 25 is intended to be as rigid as practicable, evidencing substantially no flexure, but it should not be brittle. This member provides lateral stiffness to the boot by virtue of the ankle plates 26 and translates foot motion and pressure to the skis.

Although various materials of construction may be selected, a suitable boot can be made by injection molding the various components from polyurethane formulations designed to produce parts of specified "Durometer". Durometer measurements are routinely reported in the technical literature and the specification manuals of resin suppliers. Durometer values are reported numerically, followed by a designation of the scale upon which the number is significant. For example, a Durometer value of 50D (50 units on the D scale) is actually "higher" (reflecting less compression set) than a Durometer value of 90A (90 units on the A scale). The preferred Durometer values for components of the present ski boot are approximately 50D for the traction elements, 45D for the spat, 55D for the cuff and 77D for the foot enclosure. Suitable formulations available from the Upjohn Company of Kalamazoo, Michigan, under the tradename "Pellethane" are recipe Nos. 2102-90A (for spats), 2102-55D (for cuffs), a 50 percent by weight admixture of the two (for traction elements) and a mixture of about 70 percent by weight 2102-80DX and about 30 percent by weight 2102-65DX (for the foot enclosure).

Figure 4:
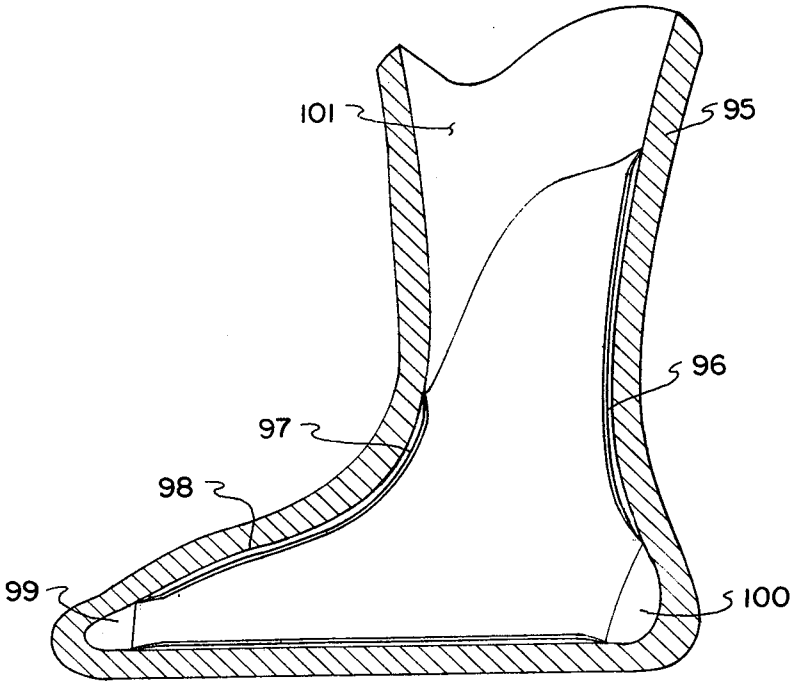
FIG. 4 is a view in cross-section of the inner boot of FIG. 3.
Figure 3:
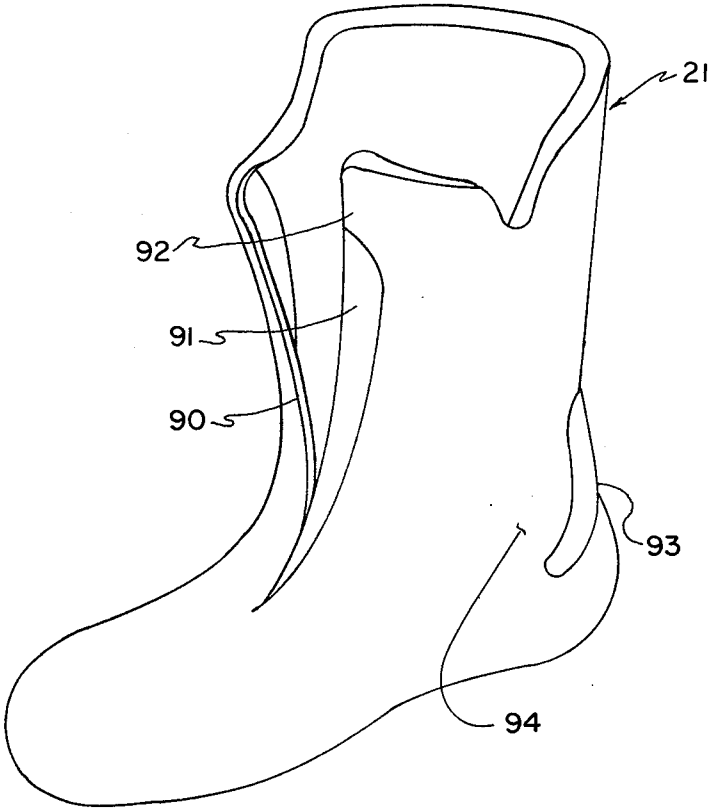
FIG. 3 is a view in perspective of an inner boot of this invention.

The inner boot 21, as illustrated by FIGS. 3 and 4, opens at the front with an outer flap 90 adapted to seat into a recess 91 provided in an inner flap 92. The inner boot 21 thus avoids the use of a separate tongue and provides a substantially continuous smooth inner surface against the front of the skier's leg. A heel tab 93 is carried on each side of the inner boot 21 behind and below the region 94 adjacent the ankle bone. These spacers urge the inner boot walls in toward the foot of the skier ensuring a snug fit in the vicinity of the heel without resort to special custom fitting procedures. The inner boot 21 comprises a pliable, semi-resilient boot 95 of padding material, such as polyurethane microcellular foam. It preferably includes a wear-resistant inner liner 96. Ideally, the inner liner 96 is formed as a sock constructed of "wet suit" material, e.g., a two-way stretch fabric 97, usually nylon, bonded to a foam closed cell backing 98. Typically, the inner liner 96 will lack portions of the toe 99 and heel 100. The preferred method of manufacture of this component is to place the inner liner 96 over a mandrel, and to foam the microcellular boot 95 in place over the mandrel. This procedure ensures a permanent mechanical bond of the foam backing 98 to the boot 95 with the liner embedded flush with the adjacent inner surface 101 of the foam boot 95.

Reference herein to details of the illustrated embodiment should not be taken as limiting the scope of the appended claims. The claims themselves recite those features regarded as essential to the invention.

I claim:

1. In a ski boot having a rigid foot enclosure and a traction member beneath said foot enclosure adapted for releasable mounting atop a ski, the improvement comprising:

providing said traction member detachable from said foot enclosure and including:

a bottom traction surface for support atop a ski;

means for attachment to conventional binding apparatus carried by a ski to hold said traction surface in fixed relationship with the top of said ski; and an upper mating surface for attachment adjacent the bottom of said foot enclosure and canted a selected degree with respect to said traction surface so that the foot enclosure is held at a selected cant with respect to a said ski when said ski boot is mounted thereon.

2. An improvement according to claim 1 wherein said traction member comprises:

a sole portion carrying means for engagement by a ski toe binding apparatus; and a heel portion carrying means for engagement by a ski heel binding apparatus.

3. An improvement according to claim 2, wherein said sole and heel portions are adapted to interlock with said foot enclosure so that forces applied by a binding apparatus to said traction member are translated to said foot enclosure and not directly to the interface between said foot enclosure and said mating surface.

4. An improvement according to claim 3, wherein said foot enclosure includes a toe end with a first integral structural extension adapted to interlock with said sole portion of said traction member and a heel end with a second integral structural extension adapted to interlock with said heel portion of said traction member.

5. An improvement according to claim 4 wherein said sole and heel portions are discrete segments.

6. An improvement according to claim 5, wherein said sole segment includes a forwardly projecting element with an upper toe surface adapted for gripping by a toe binding and a socket portion between said upper toe surface and said traction surface configurated to receive a first structural extension from said foot enclosure; and said heel segment includes a rearwardly projecting element with an upper heel surface adapted for gripping by a heel binding and a socket portion between said upper heel surface and said traction surface configurated to receive a second structural extension from said foot enclosure.

7. An improvement according to claim 1 wherein said foot enclosure is constructed of tough molded resin material with low brittleness and flexure characteristics, and said traction member is constructed of tough resinous material of high traction and abrasion resistance characteristics.

8. An improvement according to claim 7 wherein said foot enclosure is injection molded of high density polyurethane measuring between approximately 77 on the D scale durometer; and said traction member is injection molded of high density polyurethane measuring approximately 50 on the same basis.

9. An improvement according to claim 2 including in combination a plurality of interchangeable said sole and heel portions from which may be selected the sole portion and heel portion required to adapt said ski boot to a particular individual.

10. A ski boot comprising:

a rigid foot enclosure with a bottom portion configurated generally as an open-topped shoe with an enclosed toe portion, an enclosed heel portion, a bifurcated top portion and ankle plates upstanding therefrom constituting means for providing rigid lateral support;

a relatively flexible cuff portion pivotally mounted to the foot enclosure and guided by said ankle plates when said cuff is pivoted, consituting means for wrapping about and holding the lower leg of an individual; and a relatively more flexible spat portion anchored at one side of said bottom support to overlap said bifurcated top portion and carrying means for releasably latching to the opposite side of said bottom support, thereby constituting means for enclosing a foot within said foot enclosure, said spat being yieldingly engagable by said cuff when said cuff is pivoted forward.

11. A ski boot according to claim 10 including a traction element less rigid than said foot enclosure fastened to the bottom of said foot enclosure.

12. A ski boot according to claim 10 with guide pins fastened in said ankle plates extending out through slots in said cuff so that said slots ride over said guide pins when said cuff is pivoted forward and backward.

13. A ski boot according to claim 12 in combination with a plug element dimensioned to fit within a said slot so that a portion of said plug may be cut away leaving a selected portion of said slot filled, thereby limiting the travel of said cuff on said guide pins.

14. A ski boot according to claim 10 including an inner boot comprised of pliable resinous foam adapted to fit within said foot enclosure and to extend up to at least the top of the cuff.

15. A ski boot according to claim 14 wherein the front of said inner boot is bifurcated with a first side overlapping a second side, the overlapping portion of said first side being received by a recessed portion of said second side.

16. A ski boot according to claim 15 wherein said inner boot includes tabs projecting out from the vicinity of the heel thereby to ensure a snug fit beneath the ankle.

17. An inner boot for a ski boot comprising:

a pliable boot of resinous foam material, bifurcated at the front and without a tongue; and tabs integral with the outer surface of said pliable boot and extending outward from the vicinity of the heel.

18. An inner boot according to claim 17 wherein said tabs are adjacent the vicinity behind and beneath the ankle bone.

19. An inner boot according to claim 17 including an inner liner bonded to the inside surface of said pliable boot in the region surrounding the instep and top of the foot.

20. An inner boot according to claim 19 wherein said inner liner is comprised of a two way stretch fabric bonded to a closed cell foam substrate, said substrate being bonded to said pliable boot.

21. An inner boot for a ski boot, comprising:

a pliable boot formed substantially completely of resinous foam material throughout to its outer surface, bifurcated at the front with a first side overlapping a second side, the overlapping portion of said first side being received by a recessed portion of said second side.

22. An inner boot according to claim 21 including tabs integral with the outer surface of said pliable boot and extending outward from the vicinity of the heel behind and beneath the portion of the pliable boot which receives the ankle bone of a foot inserted into said pliable boot.

23. A ski boot comprising:

a rigid foot enclosure with a bottom portion configurated generally as an open-topped shoe with an enclosed toe portion, an enclosed heel portion, a bifurcated top portion and ankle plates upstanding therefrom constituting means for providing rigid lateral support;

a cuff portion, constituting means for wrapping about and holding the lower leg of an individual, pivotally mounted to the foot enclosure and including slots positioned over guide pins extending from said ankle plates and through said slots so that said slots ride over said guide pins when said cuff is pivoted forward and backward; and a spat portion anchored at one side of said bottom support to overlap said bifurcated top portion and carrying means for releasably latching to the opposite side of said bottom support, thereby constituting means for enclosing a foot within said foot enclosure said spat being yieldingly engageable by said cuff when said cuff is pivoted forward.

24. A ski boot according to claim 23 in combination with a plug element dimensioned to fit within a said slot so that a portion of said plug may be cut away leaving a selected portion of said slot filled, thereby limiting the travel of said cuff on said guide pins.

25. A ski boot according to claim 23 including coupling mechanism releasably connecting the back of said cuff to the back of said rigid foot enclosure.

26. A ski boot according to claim 25 wherein said coupling mechanism includes a buckle arrangement anchored to said heel enclosure releasably connected to an element suspended by compression springs carried by the cuff.

* * * * *